United States Patent [19]

Welch

[11] Patent Number: 5,074,222

[45] Date of Patent: Dec. 24, 1991

[54] BODY SUPPORTED TRAY TABLE

[76] Inventor: Joe A. Welch, Rte. 7, Box 1890, Laurel, Miss. 39440

[21] Appl. No.: 597,192

[22] Filed: Oct. 15, 1990

[51] Int. Cl.[5] ..... A47B 23/00

[52] U.S. Cl. ..... 108/43; 224/265

[58] Field of Search ..... 108/43, 13, 14, 12; 224/910, 265, 266, 270, 210

[56] References Cited

U.S. PATENT DOCUMENTS

| | | | |
|---|---|---|---|
| 1,191,425 | 7/1916 | Huddle | 108/43 |
| 2,304,705 | 12/1942 | Pate | 108/43 |
| 2,685,757 | 8/1954 | Mirigian | 108/43 X |
| 3,009,613 | 11/1961 | Noland | 108/43 X |
| 3,541,976 | 11/1970 | Rozas | 108/43 |
| 4,715,293 | 12/1987 | Cobbs | 108/43 |
| 4,799,610 | 1/1989 | Hsieh | 224/266 |

*Primary Examiner*—Peter A. Aschenbrenner
*Attorney, Agent, or Firm*—Ray F. Cox, Jr.

[57] ABSTRACT

A body supported tray table which may be reversed so that either an essentially flat table surface or a tray surface containing a rim can be placed uppermost relative to the user. The body supported tray table includes body support means which may be adjustable both longitudinally and transversely for ease of use and comfort to the user and which also provides for compact storage and portability.

3 Claims, 2 Drawing Sheets

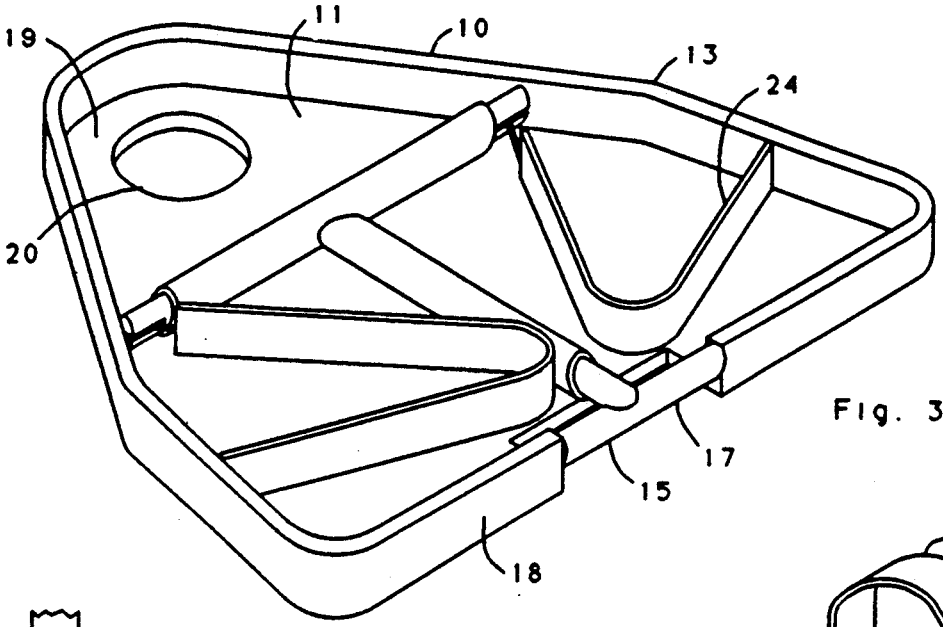
Fig. 3
Fig. 2
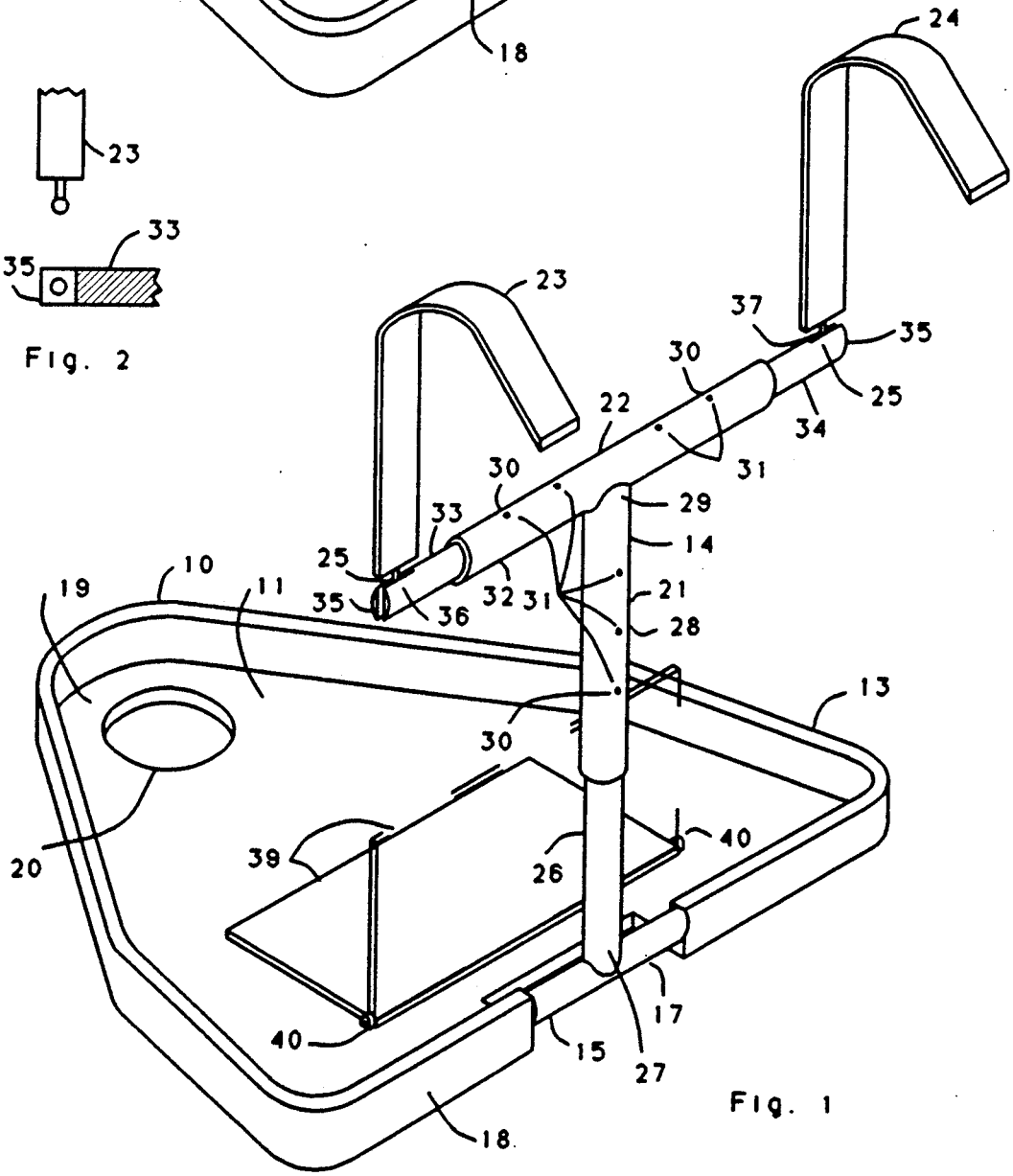
Fig. 1

BODY SUPPORTED TRAY TABLE

BACKGROUND OF THE INVENTION

This invention relates generally to a tray table that may be supported on the body of the user, and more particularly to a tray table which can be reversed so that either a tray surface or a table surface is uppermost.

Various types of body supported horizontal surfaces or platforms have been used for such purposes as writing desks, instrument supports and food or beverage trays. These devices generally provide for some means for attaching the horizontal platform to the user's body around or over the shoulders or around the neck so that the horizontal surface is held in a useable position at approximately waist level. These previous types of body supported horizontal surfaces have not provided for sufficient adjustability to insure the comfort of the user, nor have these previous devices provided for sufficient adaptability to accommodate varying body types. In addition, these previous devices have generally been adapted to a single use thereby failing to take full advantage of the full range of uses to which a device of this type can be put.

One example of the type of body supported horizontal platform known in the art is U.S. Pat. No. 3,009,613 of W.B. Noland issued Nov. 21, 1961. Noland provides for a pair of shoulder hooks to support a horizontal table shelf. Noland provides for a limited degree of adjustability of the shoulder hooks rotationally but provides for no horizontal or vertical adjustment.

Another example is U.S Pat. No. 4,715,293 issued to Richard W.Cobbs on Dec. 29, 1987. Cobbs provides for a more rigid framework and padded shoulder straps. It has limited adjustability.

U.S. Pat. No. 1,191,425 issued to H.J. Huddle issued on July 18, 1916, provides for limited vertical adjustment but no horizontal adjustment of the shoulder hooks.

U.S. Pat No. 3,090,330 issued to C.A. Best on May 21, 1963, provides for greater flexibility in adjusting the support to the body of the user through the use of flexible straps. This procedure, however, is more cumbersome and does not allow ease of placement and removal that is characteristic of shoulder hook arrangements. This comment also applies to U.S. Pat. No. 2,304,705 issued to T.G. Pate on Dec. 8, 1942, and U.S. Pat. No. 1,232,089 issued to E. Riebe on July 3, 1917.

Furthermore, none of the cited prior art makes use of both surfaces of the horizontal platform, thus limiting the potential uses and adaptability of the device to various purposes.

DISCLOSURE OF THE INVENTION

The present invention is directed toward a new and improved body supported tray table having numerous features and advantages. An important object of the invention is to provide for the utilization of both surfaces of the tray table. Another object of the invention is to provide for greater user comfort through a more flexible and adjustable means of supporting the tray table on the body of the user without sacrificing the ease of assuming and removing the device which is inherent in the use of a shoulder hook arrangement.

An additional object of the invention is to provide for easy portability through the provision of a support arrangement that is foldable into a compact shape and which, furthermore, incorporates a carrying handle which can also be used as a drink holder.

A further object of the invention is to provide for a splash guard when the invention is used as a food or beverage tray.

These and other advantages of the invention will become apparent from the subsequent detailed subscription of the preferred embodiment and the claims and drawings.

BRIEF DESCRIPTION OF THE DRAWINGS

FIG. 1 is an isometric view of the invention showing the body support means fully extended for use in the configuration where the tray surface is uppermost.

FIG. 2 is a partial sectional view of the ball and socket arrangement whereby the shoulder hooks are attached to the remainder of the support.

FIG. 3 is an isometric view of the invention fully folded for storage or carrying.

BEST MODE FOR CARRYING OUT THE INVENTION

Figure 4:
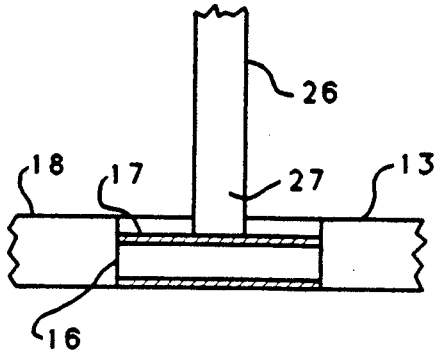
FIG. 4 is a partial sectional view of the joint attaching the tray table to the body support means.

With reference to FIG. the tray table designated generally as 10 is shown with the tray surface 11 uppermost. The tray surface is provided with a rim 13 in order to contain food, beverage or other objects placed thereon. The tray table 10 is generally triangular in shape which provides for efficient use of the surface and avoids interference with the natural use of the user's hands and arms. The body support means generally designated as 14 is attached to a joint 15 which in turn is attached to the proximal edge 18 of the tray table 10. The distal point 19 of the tray table 10 is provided with a hole 20 which is approximately two to three inches in diameter. The size of the hole and its location near the distal point 19 of the tray table 10 is selected so that the hole may be used as a handle for carrying the tray table 10. Furthermore, the hole 20 is of a size appropriate to receive and firmly hold a beverage container. The tray surface 11 is further provided with a splash guard 39 which is generally rectangular in shape and attached to the tray surface 11 by means of hinges 40 so that the splash guard 39 may be folded flat against the tray surface 11 for storage or transport and raised into a vertical position as shown by the broken lines on FIG. 1 during use.

Figure 5:
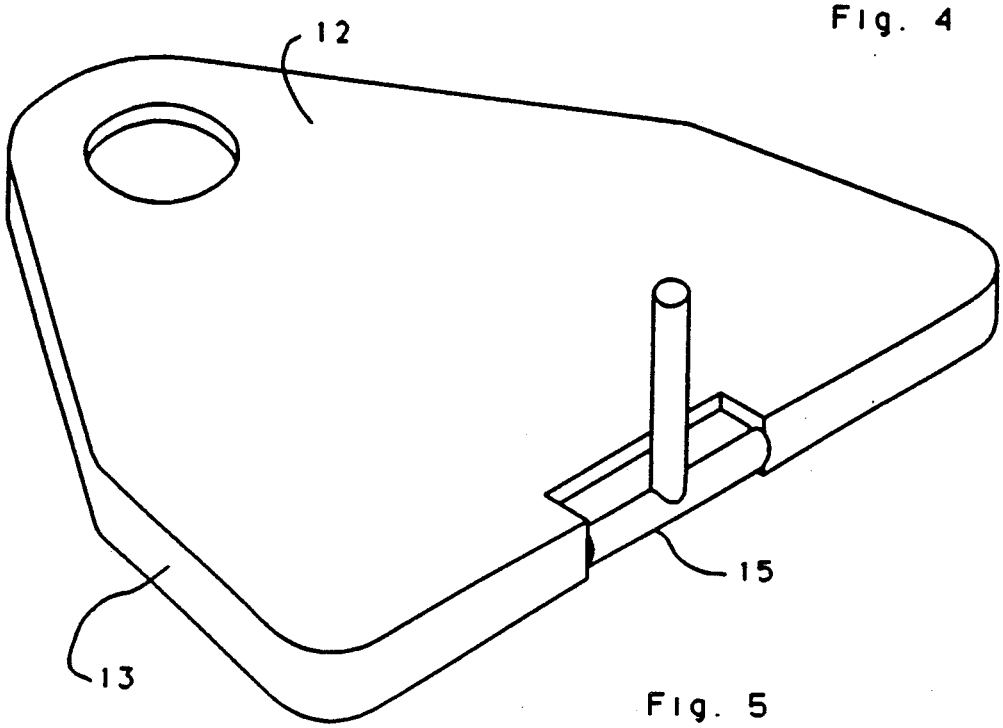
FIG. 5 is a partial isometric view of the invention with the table surface uppermost and the body support means extended for use. Only the joint and a portion of the body support means is illustrated. The remainder of the body support means is removed for clarity.

The body support means 14 includes longitudinal adjustment means designated generally as 21 and transverse adjustment means designated generally as 22 and first and second shoulder hooks 23, 24. The joint 15 provides for rotation of the body support means 14 relative to the tray table 10 through at least 270 degrees allowing either the tray surface 11 or the table surface 12 to be placed uppermost relative to the body support means 14. As illustrated in FIG. 5, the table surface 12 is essentially flat and could be used as a writing surface or to support an object that could not be contained within the rim 13 on the tray surface 11.

As illustrated in FIG. 5 the joint 15 includes a cylinder 16 which is rigidly affixed to the proximal edge 18 and particularly to the rim 13. A coaxial sleeve 17, illustrated in FIG. 4 as a cut-away section, is frictionally coupled to the cylinder 16. The frictional coupling allows for continuous adjustments of the orientation of the tray table 10 relative to the body support means 14. This method of frictional coupling also avoids complicated and cumbersome mechanisms for locking the tray table 10 into position. The coaxial sleeve 17 is rigidly affixed to the body support means 14.

The longitudinal adjustment means 21 includes an inner coaxial longitudinal cylinder 26 having a proximal end 27 rigidly affixed to the coaxial sleeve 17 and an outer coaxial longitudinal cylinder 28 having a distal end 29. The outer coaxial longitudinal cylinder 28 is slidably adjustable with the inner coaxial longitudinal cylinder 26 in order to provide for varying longitudinal adjustments depending on the user's body shape and the most comfortable position at which to place the tray table 10 relative to the user. The inner coaxial longitudinal cylinder 26 and the outer coaxial longitudinal cylinder 28 may be locked into position by means of a spring loaded detent 30 having a plurality of locking positions 31. Spring loaded detents of this type are well known in the art.

As further illustrated in FIG. 1, the transverse adjustment means generally designated as 22 include an outer coaxial transverse cylinder 32 rigidly affixed to the distal end 29 of the outer coaxial longitudinal cylinder 28 and first and second inner coaxial transverse cylinders 33, 34 each having outer ends 35. The inner coaxial transverse cylinders 33, 34 are slidably adjustable within the outer coaxial transverse cylinder 32 so that the position of the shoulder hooks can be adjusted for the most comfortable position on the user. Furthermore, the inner coaxial transverse cylinders 33, 34 may be locked into position relative to the outer coaxial transverse cylinder 32 by means of spring loaded detents 30 having a plurality of locking positions 31.

The first and second shoulder hooks 23, 24 are attached to the outer ends 35 of the inner coaxial transverse cylinders 33, 34 by means of first and second ball and socket joints 36, 37. FIG. 2 is a disassembled sectional view of ball and socket joint 36. The ball and socket joints 36, 37 allow the shoulder hooks to be adjusted rotationally in a lateral direction. Furthermore, the shoulder hooks 23, 24 may be reversed relative to the body support means 14 when the tray table 10 is reversed. Furthermore, as illustrated in FIG. 3, when the body support means 14 is folded for storage within the rim 13 the shoulder hooks 23 and 24 may be rotated downwardly and rotationally to fit compactly within rim 13.

The invention has been described according to a preferred embodiment wherein the various component parts are constructed of light weight molded plastic materials for both ease of construction and ease of use as well as providing comfort to the user.

It is understood that various changes and modifications may be made to the invention as described without departing from the spirit and scope of the invention as set forth in the following claims.

What is claimed:

1. A body supported tray table comprising a tray table having a table surface and a tray surface, said table surface being substantially flat and said tray surface having a raised rim; body support means comprising longitudinal adjustment means, transverse adjustment means, first and second shoulder hooks, and shoulder hook adjustment means; a joint comprising a cylinder rigidly affixed to said tray table and a coaxial sleeve frictionally coupled to said cylinder and rigidly affixed to said body support means such that said coaxial sleeve is frictionally rotatable relative to said cylinder through at least 270 degrees; said longitudinal adjustment means further comprising an inner coaxial longitudinal cylinder having a proximal end and an outer coaxial longitudinal cylinder having a distal end, said inner coaxial longitudinal cylinder and said outer coaxial cylinder being mutually slidably adjustable and lockably adjustable by means of a spring-loaded detent having a plurality of locking positions, and said proximal end of said inner coaxial longitudinal cylinder being rigidly affixed to said coaxial sleeve; said transverse adjustment means further comprising an outer coaxial transverse cylinder rigidly affixed perpendicular to said distal end of said outer coaxial longitudinal cylinder, first and second inner coaxial transverse cylinders each having an outer end, said first and second inner coaxial transverse cylinders being slidably adjustable within said outer coaxial transverse cylinder, and each of said inner coaxial transverse cylinders being lockably adjustable by means of a spring-loaded detent having a plurality of locking positions; and said shoulder hook adjustment means further comprising first and second ball-and-socket joints located on the respective outer ends of said first and second inner transverse coaxial cylinders and connecting said first and second shoulder hooks to said first and second inner coaxial transverse cylinders respectively.

2. A body supported tray table as set forth in claim 1, wherein said tray table is substantially triangular in shape, having a proximal edge attached to said joint and a distal point, and further wherein said tray table contains a hole approximately two to three inches in diameter near said distal point.

3. A body supported tray table as set fourth in claim 2 wherein a splash guard is hingedly attached to said second surface of said tray table.

* * * * *